United States Patent [19]

Radek

[11] 4,411,102

[45] Oct. 25, 1983

[54] DOOR CONTROL

[75] Inventor: John R. Radek, Hinsdale, Ill.

[73] Assignee: Ready Metal Manufacturing Company, Chicago, Ill.

[21] Appl. No.: 179,961

[22] Filed: Aug. 20, 1980

[51] Int. Cl.[3] ..... E05F 17/00

[52] U.S. Cl. ..... 49/110; 49/111; 49/113; 49/252

[58] Field of Search ..... 49/113, 110, 118, 111, 49/252, 248-251, 344, 356, 104, 105, 109, 112

[56] References Cited

U.S. PATENT DOCUMENTS

| | | | |
|---|---|---|---|
| 693,385 | 2/1902 | Faulds | 49/113 X |
| 2,330,005 | 9/1943 | Odenthal | 49/118 X |
| 2,501,897 | 3/1950 | Guimont | 49/113 X |
| 3,402,509 | 9/1968 | Haglund | 49/504 X |
| 4,286,411 | 9/1981 | Wikkennk et al. | 49/430 X |
| 4,322,912 | 4/1982 | Heinrich | 49/340 X |

*Primary Examiner*—Kenneth Downey
*Attorney, Agent, or Firm*—Frank H. Marks

[57] ABSTRACT

A Door Control designed especially for a service passage in a quick food establishment or the like, i.e., for serving customers on one side of a passage, say, in a cubicle, by an employee on the other side thereof. Essentially, such control mechanism comprises a device operable by an employee for opening a door or pair of doors normally closing a passage while business may be transacted through the passage such as placing or delivering an order, after which the door or pair of doors is automatically closed. My invention represents an improvement over that disclosed and claimed in my copending application Ser. No. 06/078,095, filed Sept. 24, 1979, now abandoned. In the instant case the doors are so controlled and actuated that, after opening, they are disposed on opposite sides and rearwardly of said passage, not extending substantially forwardly thereof. This feature is of importance in that, if extending forwardly of the cubicle wall, the doors might be subject to possible damage from a moving vehicle; further, in that maximum space is left between the open doors for transaction of business. My invention also contemplates new and improved mechanism for actuating, supporting and retracting the doors most simply and efficiently from closed to open position and reverse.

4 Claims, 9 Drawing Figures

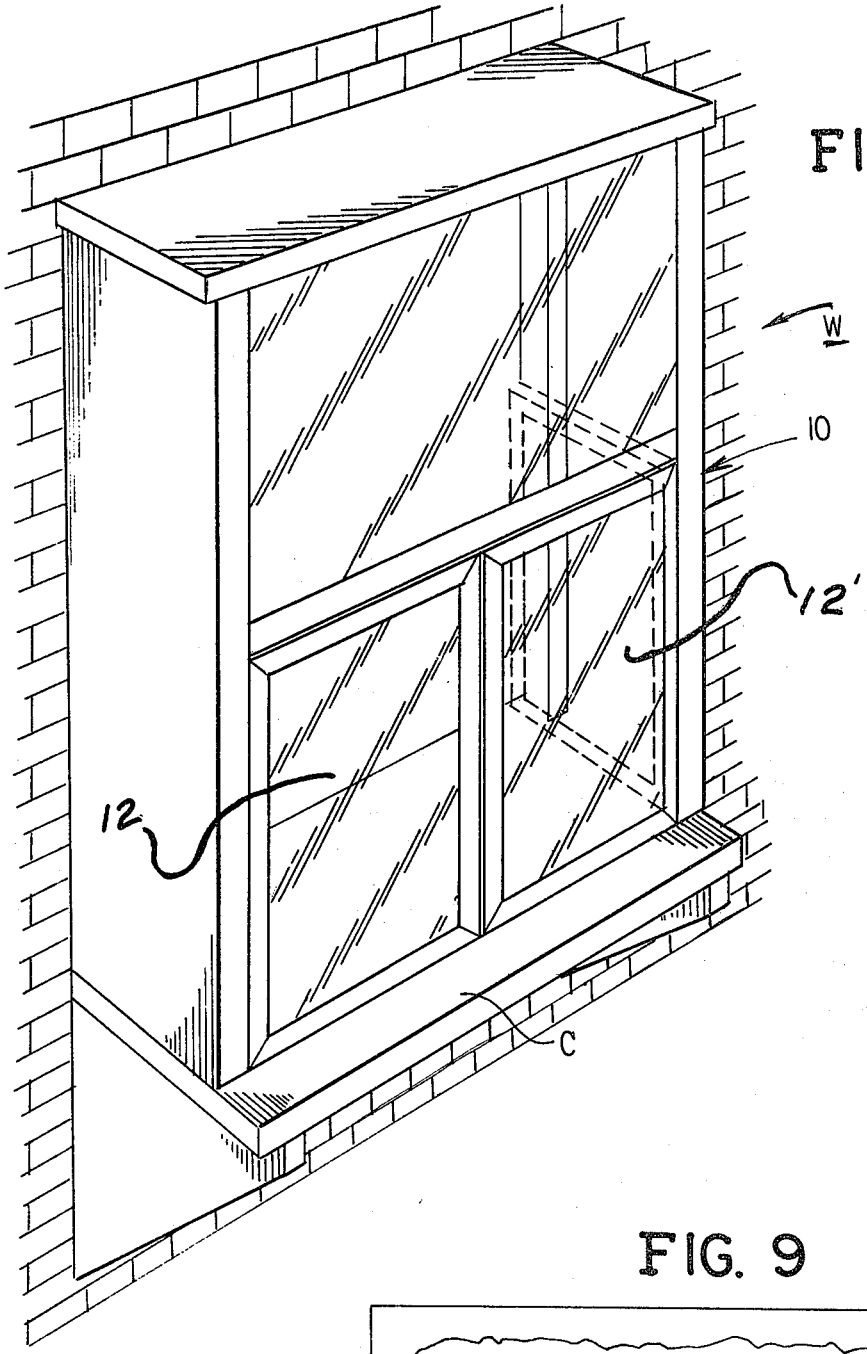
FIG. 1
FIG. 9
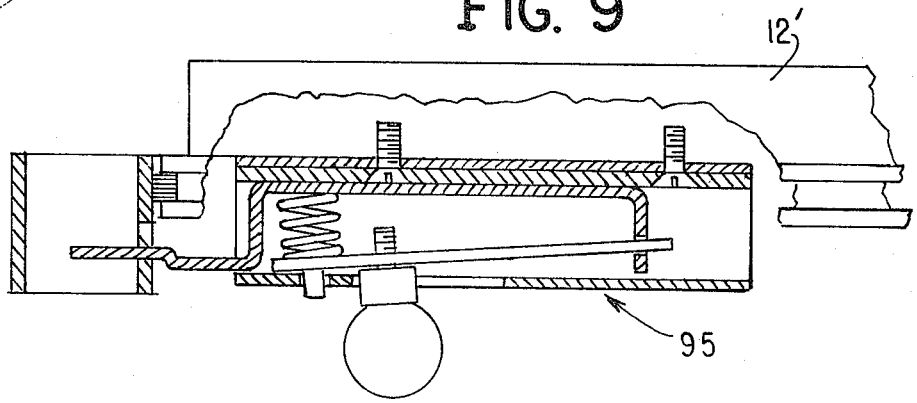

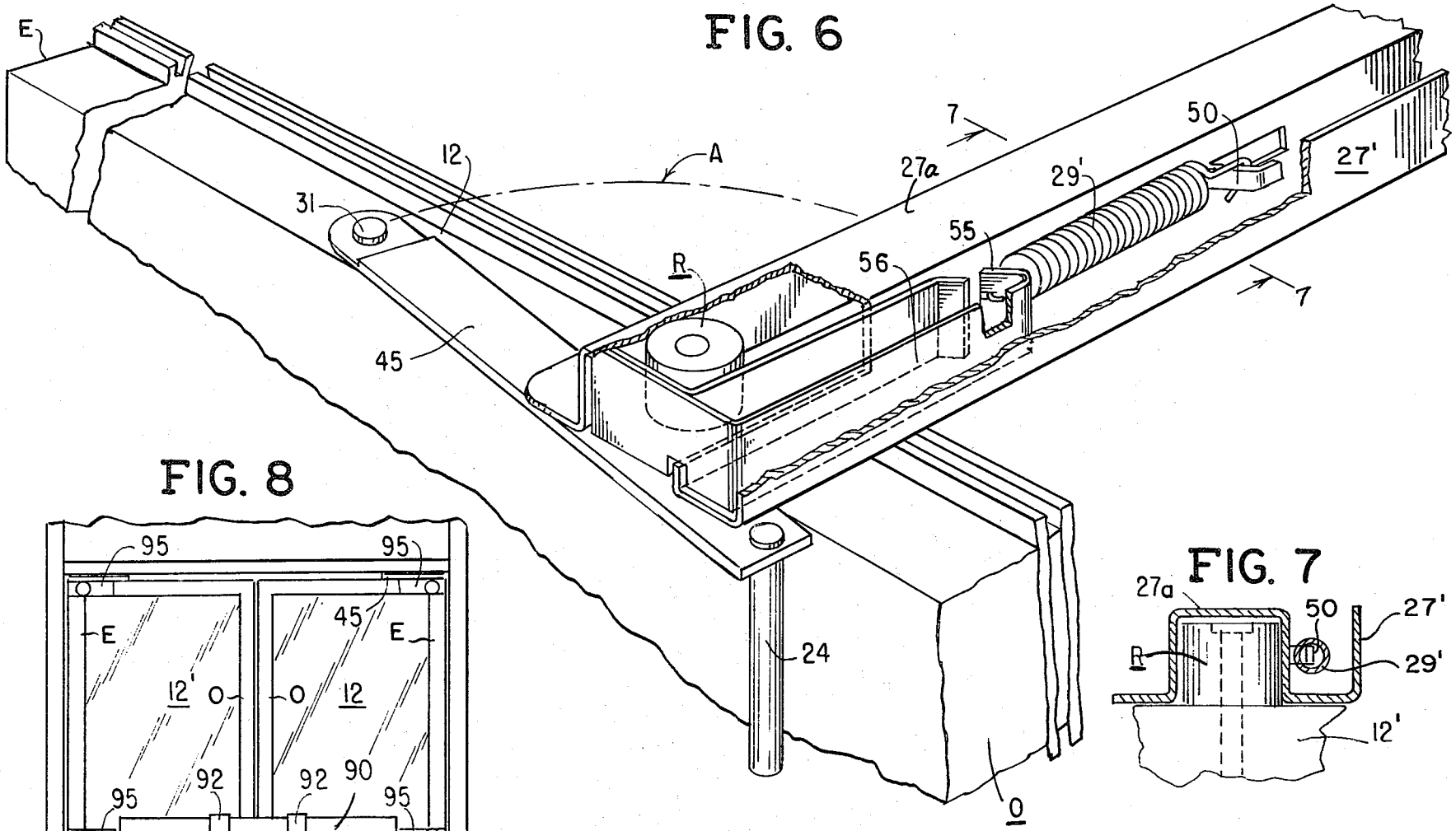
FIG. 6
FIG. 7
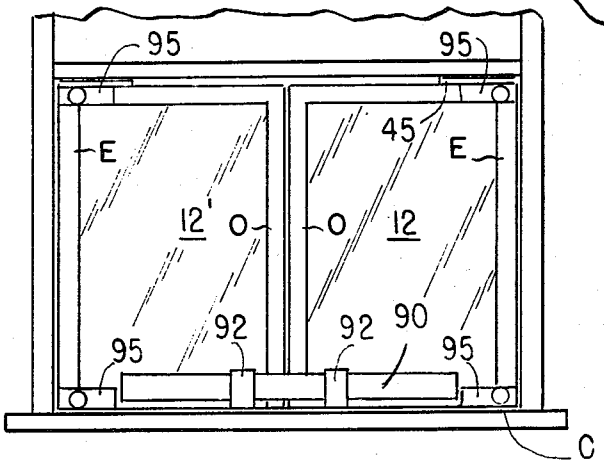
FIG. 8

DOOR CONTROL

My invention relates to Door Controls, and more particularly to means for actuating a service door in a fast food establishment or the like.

BACKGROUND

I am aware that the prior art includes various means for actuating a pair of doors simultaneously, including a variety of mechanical devices for opening and closing them. In some cases the doors slide in their own planes; in others they rotate oppositely on their axes. More pertinent within my knowledge is my copending application Ser. No. 06/078,095, filed Sept. 24, 1979, now abandoned, and prior art that may be cited therein.

My prior invention discloses and claims a pair of doors normally closing a service passage in a cubicle, which doors may be actuated for opening by a human operator behind the cubicle who applies muscular force to a reciprocable plunger that acts through a mechanical system to rotate said doors simultaneously and in opposite axial directions to open position on either side of the passage, where they remain until pressure on the plunger is relieved. Thereupon the doors are automatically returned to closed position.

In commercial use of said prior invention, it sometimes happens that the doors are damaged when open because of their protrusion outwardly beyond the cubicle into the path of a moving vehicle. Otherwise, embodiments of said invention have proven entirely satisfactory in commerce.

BRIEF OUTLINE OF INVENTION

An object of my present improvement is to provide doors of the character described that, in opening, move to positions entirely within the confines of the cubicle and behind the passage, and on opposite sides thereof.

Thus, in open position, the doors will not project in any substantial degree outwardly into the path of a moving vehicle, no matter how close said vehicle may move to the cubicle. As in my prior invention, the doors may be actuated by a reciprocable plunger controlled by muscular effort of a human operator within the cubicle, as by a knee, hip or thigh below the counter level, leaving the operator's hands free. As in my prior invention, the doors are automatically returned to closed position.

A further object of my invention is to provide simple and efficient mechanism for transmitting movement from the aforesaid plunger to open the doors and means for automatically retracting said mechanism to effect closing of the doors, including means for cushioning said action to prevent excessive wear and tear on the mechanism.

Movement of the doors in my new and improved invention is accomplished by a mechanical arrangement, thought to be novel, whereby the doors are simultaneously rotated on unfixed vertical axes while being translated laterally from coplanar positions closing the passage to positions facing each other on opposite sides of the passage, rearwardly of the front face of the cubicle and more remote from the center thereof, leaving much clear space on the counter for transaction of business. The angle of rotation of the doors is roughtly 90°.

The aforesaid movement is accomplished through a transmission mechanism from the plunger, controlled by a human operator, moving the doors through a linkage combination including a bell crank lever rotatable on a fixed pivot and other elements. The doors are further controlled by means of a bearing member affixed thereto and slideable in a horizontal track vertically displaced relative to the doors, above the doors in a preferred embodiment shown, though not necessarily.

A feature of my invention is means augmenting the door closing mechanism for initiating return movement of the doors to closed position, to overcome possible resistance.

Various other objects and advantages will doubtless become apparent as the description proceeds.

BRIEF DESCRIPTION OF DRAWINGS

Referring now to the drawings forming a part of this specification and illustrating a preferred embodiment of my invention, FIG. 1 is a front perspective view showing the outside of a service cubicle of a quick food establishment or the like, including doors embodying my invention;

FIG. 6 is a fragmentary perspective on an enlarged scale of a door and associated actuating elements, with parts broken away, and with door in open position;

FIG. 7 is a section viewed substantially along line 7—7 of FIG. 6;

FIG. 8 is an elevational view, on a reduced scale, generally similar to FIG. 2 but viewed from behind, to show certain window locking devices employed with my invention, and FIG. 9 is a sectional view detailing a suitable door latch employed with my invention.

DETAILED DESCRIPTION

Figure 2:
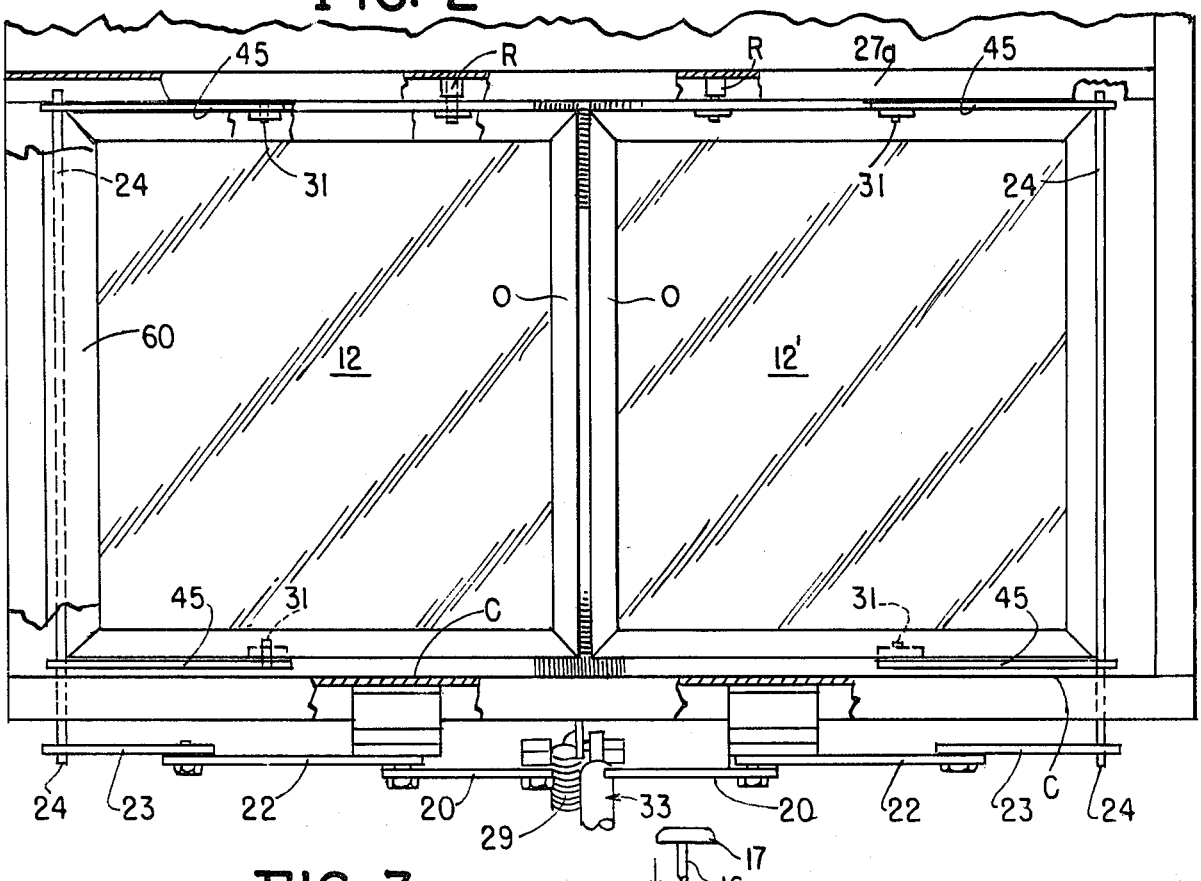
FIG. 2 is a front elevation, partly in section, of the doors seen in FIG. 1, with associated parts, certain of which are broken away for added clearness.

Referring first to FIG. 1, reference character W indicates the front wall of a business concern, say, a fast food establishment, having a cubicle 10 designed to serve "carry out" customers. More specifically, the cubicle is provided with a desk or counter C for receiving and dispensing orders, merchandise and payment for same. Normally, an employee may stand behind the cubicle as merchandise, money, etc., passes over counter C between customer and employee in the transaction of business.

After a customer has approached the cubicle, the employee proceeds to open doors 12, 12' providing access to the cubicle, by application of muscular force to a pushrod 16 disposed below the counter, as by pushing axially by hip or hand, a padded knob 17 on the free end of the pushrod, leaving the employee's hands free for transaction of business. Such movement of rod 16 in a straight line from rear to front of the cubicle serves to open doors 12, 12 in a manner and by means to be described, opening a passage normally closed by said doors.

Figure 3:
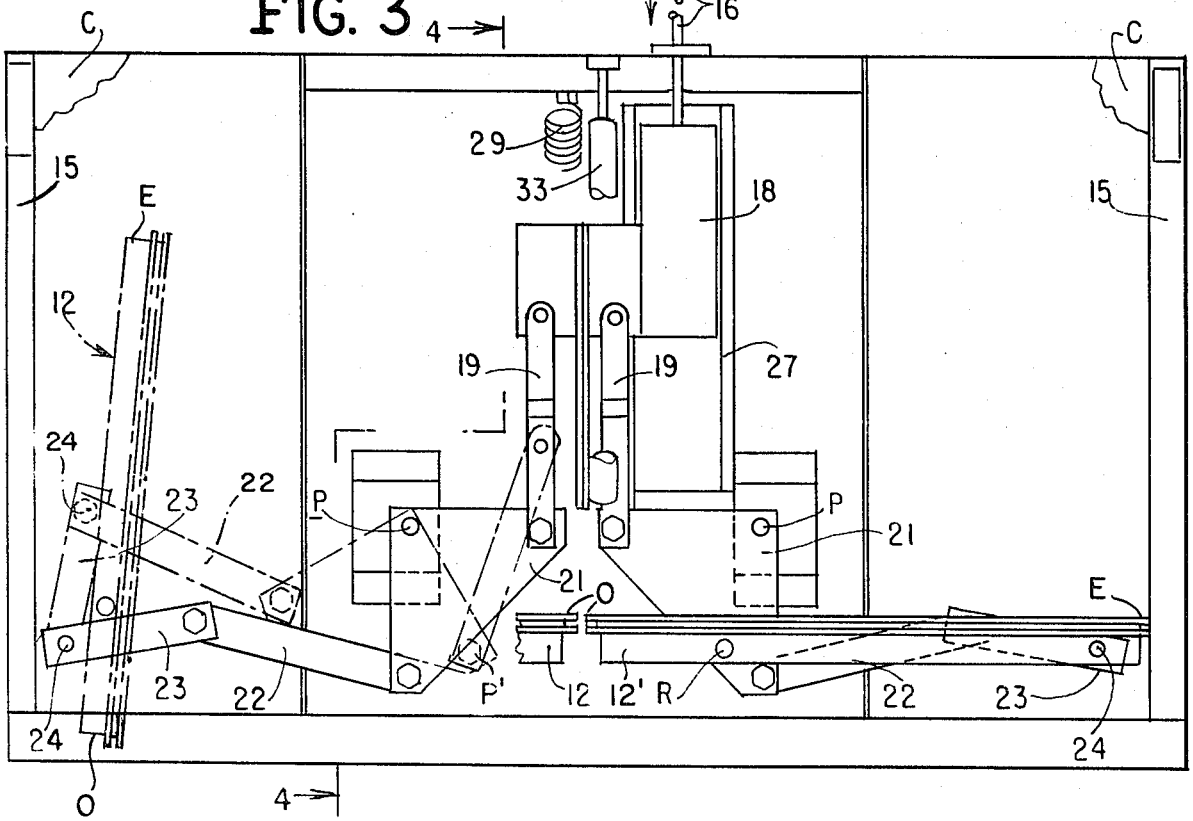
FIG. 3 is a top plan view of the closed doors and elements of their actuating mechanism disposed under the counter, one door and actuating parts phantomed in open position.
Figure 4:
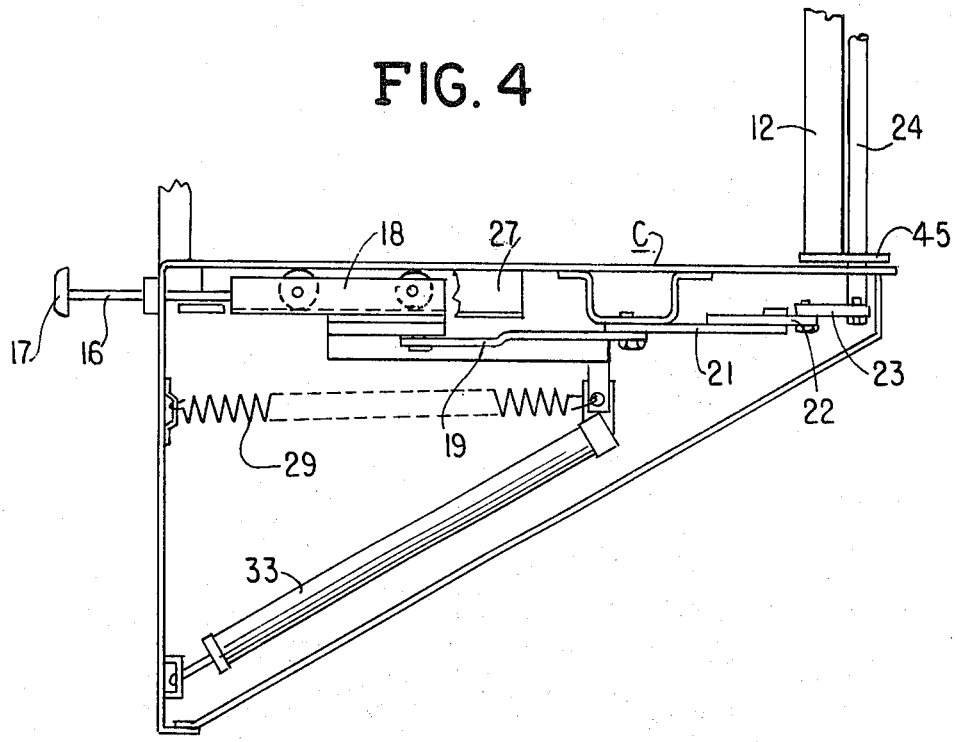
FIG. 4 is a fragmentary detailed elevational view showing parts of the actuating and retracting mechanism disposed below the service counter.

Translation of rod 16 forwardly, as just described, moves in the same direction a carriage 18 (FIGS. 3, 4) equipped with roller bearings riding in tracks 27. Said carriage is pivotally connected to links 19, 19 serving the respective doors, each of said links in turn being pivotally attached to triangular plates 21, 21, functioning as bell cranks mounted to rotate on fixed pivots P, P.

The push rod 16 and mechanism actuated thereby and described so far are disposed below counter C, leaving said counter free and clear for transaction of business.

Doors 12, 12' may be glazed, if desired, for the convenience of the employee and customer.

It will be understood that transmission mechanism for conveying motion from the push rod to the doors is substantially similar to each door, i.e., duplicated, whereby substantially the same action is conveyed simultaneously to both doors. Hence, the door opening mechanism will be described for only one door with the understanding that similar parts are provided for both doors, the two acting in reverse.

Figure 5:
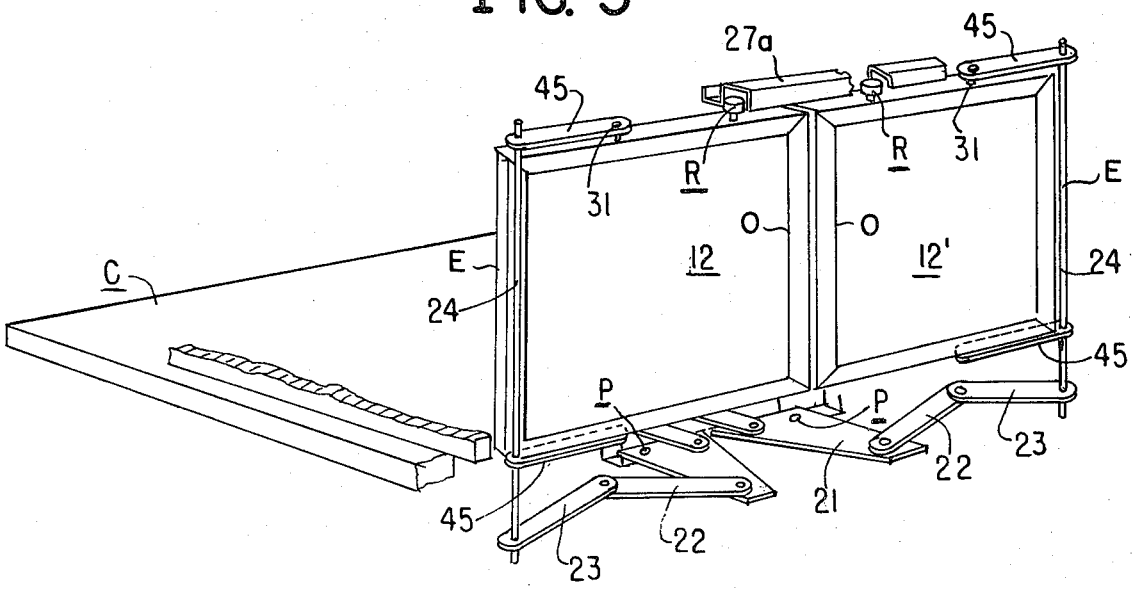
FIG. 5 is a fragmentary front perspective view of the doors and some of their actuating elements below and above the doors.

Each of said plates 21, 21 has pivotally connected at a vertex P' a link 22 which in turn is pivotally connected to another link 23. The last mentioned link or lever 23 is keyed to a vertically extending rod 24, mounted for rotary movement on its axis and thus designed to transmit motion from a plane below the level of doors 12 to a plane above them (FIGS. 2, 5, 6).

Adjacent their upper ends, each rod 24 is keyed to a crank bar 45 (FIGS. 2,5,6) which is pivotally connected at its other end to a pintle 31 on the top edge of the door. Spaced from pintle 31 on top of the door is a roller bearing R which is slideable in a channel member 27*a*. The latter forms part of a generally S-shaped member (see FIG. 7).

Thus, rotation of rod 24 by mechanism under the counter, described hereabove, acts through crank 45 to swing the door through an arc A, indicated dotted in FIG. 6, from closed to open position.

By reference to FIGS. 6 and 7, it will be seen that, as door 12 is swung by lever 45 to open position, inner edge O of the door is translated toward the side of the passage while outer edge E is rotated by the counterclockwise movement of lever 45 in arc A, away from the passage, said movement being controlled by roller R riding in channel 27*a*. It should be obvious that the channel is fixedly mounted in the cubicle above the doors.

As an important incident of the aforesaid action, the mid-portion of the counter is largely left clear in the course of door movement, facilitating business transaction.

When muscular force is withdrawn from push rod 16 (FIG. 4), a tension spring 29 below the counter exerts force on carriage 18 to effect closing of the doors by reverse movement of the mechanism described above.

A pneumatic check valve 33, which may be of known or other suitable design, may be provided to cushion the closing action.

Means is provided (FIG. 6) to initiate door closing, to overcome possible resistance. Such initiating means may comprise a helical spring 29' disposed in a channel 27' and attached at one end to an ear 50 struck out from a wall of S-shaped member 27*a*, the other end of the spring being secured to an L-shaped bar 55. Short leg 56 of said bar bears against roller R (FIG. 6).

Thus, opening movement of the door places spring 29' under tension (FIG. 6), storing energy which is applied through roller R when pressure is relieved on push rod 16, to initiate clockwise movement of the door toward closed position.

As seen in FIG. 2, cover members 60 may be provided to conceal rods 24, for esthetic purposes.

It may sometimes be desired to lock the doors against ingress from outside the cubicle. Locking devices of widely varying forms may be provided inside the cubicle, FIGS. 8 and 9 showing certain suitable examples.

Thus, a simple expedient is a crossbar 90 removably seated in a pair of simple stirrup-like elements 92, the latter attached to the inside of the doors.

In lieu of, or in addition to, the crossbar arrangement, I may provide corner latches 95 (FIG. 8), the construction and operation of which is thought to be apparent from the detailed section. The latching dog may be slideable or pivoted, as desired.

CONCLUSION

It will be seen that I have provided a relatively simple mechanism for opening and closing a door or pair of doors to provide an open passage with maximum utilizable space for transaction of business on a counter.

Movement of the doors, resulting from muscular effort applied in a straight line force from a push rod, is a combination of rotation to a plane generally normal to that of the closed position and also translated laterally away from the center of the passage, enhancing the working space area.

Various changes within the spirit of my invention may suggest themselves to those skilled in the art. Hence, I do not wish to be limited to the precise forms shown or uses mentioned, except to the extent indicated by the appended claims. For example, parts described as positioned above the doors may, without departing from the spirit of my invention, be positioned therebelow.

I claim:

1. In combination with an inclosure having a horizontal shelf and a passage thereabove normally disposed between a clerk on one side and a customer on the other for transaction of business, a pair of swinging doors lying in a common vertical plane normally closing said passage, said doors having adjacent substantially meeting edges when closed and a vertical actuating rod mounted for axial rotation adjacent the edge of each door remote from said adjacent edges, and means for simultaneously opening and closing said doors, comprising, (a) a reciprocable carriage below said shelf and a horizontal, spring-biased actuator therefor with analogous mechanisms between said carriage and said actuator for swinging said doors simultaneously from closed position to their open positions in opposed planes approximately 90° from the plane of their closed position, (b) each of said mechanisms comprising a bell-crank lever having a fixed pivotal fulcrum and pivots on opposite sides of said fulcrum, (c) first linkage means extending between said carriage and one of said pivots, (d) second linkage means extending between the other of said pivots and the respective rod and keyed to the lower end thereof for rotation of the rod on its axis, (e) a crank arm keyed to the upper end of said rod and pivotally mounted to the upper edge of said door intermediate the vertical edges thereof, (f) a guide roller mounted on the upper edge of the door intermediate the vertical edges thereof, (g) guide means for said roller above the door and in the plane of the doors when in closed position, and (h) means for automatically actuating said carriage reversely to effect simultaneous closing of the doors.

2. An apparatus as set forth in claim 1, wherein said first-mentioned spring-biased actuator is controlled by muscular pressure exercized by the clerk, and said last-mentioned means is activated by the release of said pressure.

3. An apparatus as set forth in claim 2, including shock-absorbing means connected to said reciprocable carriage to buffer the closing of the doors upon release of the muscular pressure.

4. An apparatus as set forth in claim 1, including spring means supplementing said last-mentioned means for initiating the closing movement of the doors.

* * * * *